US006036167A

United States Patent [19]

Wade

[11] Patent Number: 6,036,167

[45] Date of Patent: Mar. 14, 2000

[54] SOLENOID-ACTUATED CONTROL VALVE WITH MECHANICALLY COUPLED ARMATURE AND SPOOL VALVE

[75] Inventor: Richard A. Wade, Shelby, N.C.

[73] Assignee: Fasco Controls Corp., Shelby, N.C.

[21] Appl. No.: 09/139,949

[22] Filed: Aug. 25, 1998

[51] Int. Cl.[7] ..... F16K 31/04; F16K 31/383; F16K 31/42

[52] U.S. Cl. ..... 251/30.04; 123/41.12; 123/41.49; 251/38; 251/44

[58] Field of Search ..... 123/41.12, 41.49; 251/30.03, 30.04, 38, 44

[56] References Cited

U.S. PATENT DOCUMENTS

| | | | |
|---|---|---|---|
| 2,624,542 | 1/1953 | Ghormley | 251/38 |
| 2,654,393 | 10/1953 | Ghormley | 251/38 |
| 2,700,397 | 1/1955 | Compton | 251/30.03 |
| 4,567,914 | 2/1986 | Coppola et al. | 137/625.64 |
| 4,709,666 | 12/1987 | Merz | 123/41.12 |
| 4,798,177 | 1/1989 | Oomura et al. | 123/41.12 |
| 5,184,644 | 2/1993 | Wade | 137/625.64 |
| 5,282,604 | 2/1994 | Wade | 251/129.17 |
| 5,323,809 | 6/1994 | Tischer et al. | 137/596.17 |
| 5,531,190 | 7/1996 | Mork | 123/41.12 |
| 5,769,386 | 6/1998 | Sugiura et al. | 251/30.04 |

*Primary Examiner*—George L. Walton
*Attorney, Agent, or Firm*—Myers, Bigel, Sibley & Sajovec

[57] ABSTRACT

Solenoid-actuated control valves having low hysteresis include an annular flux housing with an axial bore extending therethrough. A coil configured to generate a magnetic field is disposed within the flux housing. A magnetic pole piece is disposed within the flux housing axial bore. A magnetic armature is slidably secured within the flux housing axial bore. A spring, positioned between the pole piece and armature, is configured to urge the armature away from the pole piece. A spool valve, slidably secured within a spool sleeve, is mechanically coupled with the armature such that the spool valve follows movement of the armature as a slave.

37 Claims, 6 Drawing Sheets

40
42
44
46
48
4
50
50a
50b
51
52
53
54
56
60
62
68
76
78
80

SOLENOID-ACTUATED CONTROL VALVE WITH MECHANICALLY COUPLED ARMATURE AND SPOOL VALVE

FIELD OF THE INVENTION

The present invention relates generally to control valves and, more particularly, to solenoid-actuated control valves.

BACKGROUND OF THE INVENTION

Heat is conventionally removed from the coolant of an internal combustion engine by passing the coolant through a radiator. One or more cooling fans are conventionally utilized to draw air across the radiator to facilitate heat removal from the coolant flowing therewithin. Cooling fans may be driven directly from an internal combustion engine or may be independently driven via a separate power source.

Cooling fans directly driven by an internal combustion engine have several disadvantages compared with cooling fans driven via separate power sources. One disadvantage is that fan speeds may be inadequate at some engine speeds which may result in inadequate or inefficient heat removal. For example, at low engine speeds, a cooling fan directly driven by an internal combustion engine may not have sufficient speed to adequately draw air through a radiator. Accordingly, at low engine speeds, the ability to adequately remove heat from engine coolant may be reduced. At high engine speeds, a cooling fan directly driven by an engine may have excessive speed, thereby drawing excessive air through a radiator. This may result in overcooling.

Furthermore, when a cooling fan is driven directly from an internal combustion engine, mechanical devices, such as belts, splined shafts, chains, and the like may be necessary to transfer power from the engine to the cooling fan. These mechanical devices may increase the complexity and expense of an internal combustion engine and may decrease the efficiency thereof.

Cooling fans driven by an electrical motor are conventionally configured to cycle on and off at predetermined coolant temperatures. Unfortunately, electrical motors serving in this capacity may have various disadvantages. One disadvantage is that an electrical motor of sufficient power to drive one or more cooling fans may place a strain on a vehicle's electrical system. Also, the physical size of some electrical fan motors may be somewhat large and, as a result, undesirable for automotive use. In addition, electrical motors for driving cooling fans may be somewhat noisy. Unfortunately, efforts to reduce electrical motor noise may add to manufacturing costs and may decrease electrical motor efficiency.

Cooling fans may also be driven by hydraulic motors. The rotational speed of a cooling fan driven by a hydraulic motor is conventionally controlled by varying the rate of flow of a working fluid being pumped to the hydraulic motor that drives the cooling fan. Typically, the rotational speed of a hydraulic motor is increased as coolant temperature increases. Conversely, the rotational speed of a hydraulic motor is decreased as coolant temperature decreases.

The rate of flow of fluid to a hydraulic motor may be controlled via a solenoid-actuated control valve. Unfortunately, conventional solenoid-actuated control valves have various limitations. For large internal combustion engines, multiple cooling fans may be required. As a result, fluid flow requirements may be rather high. For example, a pair of hydraulic motors for driving cooling fans may jointly require between 15 and 20 gallons per minute (GPM) of hydraulic fluid to adequately rotate the cooling fans.

Unfortunately, conventional solenoid-actuated control valves may not be able to sufficiently handle flow rates of this magnitude. This is because flow forces imposed on the internal components of a control valve at high flow rates are often quite large and unstable (non-linear). Unstable flow forces may result in unsatisfactory performance by a hydraulic motor. In addition, the design of many conventional solenoid-actuated control valves may lead to an increase in valve hysteresis at large flow rates.

SUMMARY OF THE INVENTION

In view of the above discussion, it is an object of the present invention to facilitate the use of hydraulic motors for driving cooling fans for use with internal combustion engines.

It is another object of the present invention to provide solenoid-actuated control valves with reduced hysteresis, especially at high flow rates.

It is another object of the present invention to provide solenoid-actuated control valves that can operate at high flow rates while maintaining stable flow.

These and other objects of the present invention are provided by a low hysteresis solenoid-actuated control valve having a spool valve mechanically coupled with an armature of the solenoid so as to follow the armature as a slave. An annular flux housing having an axial bore extending therethrough houses a coil configured to generate a magnetic field. A magnetic pole piece is disposed within the flux housing axial bore and a magnetic armature is slidably secured within the flux housing axial bore. A spring is positioned between the pole piece and the armature and is configured to urge the armature away from the pole piece. A spool sleeve is secured to the flux housing and includes a supply port and an exhaust port. A spool valve is slidably secured within the spool sleeve and is mechanically coupled with the armature such that the spool valve follows movement of the armature as a slave.

According to a preferred embodiment, an annular flux housing includes opposite first and second end portions and an axial bore extending between the first and second end portions. A bobbin is disposed within the flux housing and has conductive wire coiled therearound for generating a magnetic field. A magnetic pole piece is disposed within the axial bore of the flux housing adjacent the flux housing first end portion.

An armature chamber is also disposed within the flux housing annular bore adjacent the second end portion of the flux housing. A magnetic armature is slidably secured within the armature chamber. The armature includes a body portion terminating at opposite first and second ends. The armature body portion includes a substantially flat, axially extending portion and an outwardly-extending, circumferential bearing. The flat, axially extending portion is configured to allow supply fluid to flow upwardly within the armature chamber. The circumferential bearing is configured to reduce contact between the armature and the armature chamber, thereby reducing friction that can cause valve hysteresis.

A spring is disposed between the pole piece and the armature and is configured to urge the armature in an axial direction away from the pole piece. Together, the flux housing, armature and pole piece form a magnetic flux circuit such that flow of electrical current within the coiled conductive wire creates a magnetic field which causes the armature to move axially within the armature chamber towards the pole piece.

A spool sleeve, having a central bore therethrough, has a free end and an opposite end secured to the flux housing second end portion such that the central bore and armature chamber are in fluid communication with each other. The spool sleeve includes a supply port adjacent the free end and an exhaust port adjacent the end secured to the flux housing. The supply and exhaust ports are in respective fluid communication with the central bore of the spool sleeve.

A spool valve is slidably secured within the spool sleeve central bore and has spaced-apart first and second valve portions joined together by an intermediate body portion. The first valve portion is configured to meter fluid flow through the supply port. The second valve portion is configured to control fluid flow through the exhaust port. The intermediate body is portion of the spool valve has a smaller diameter than the first and second valve portions and forms, in combination with the spool sleeve central bore, an annular chamber in communication with the supply and exhaust ports. The shape of the spool valve helps produce linear flow forces between the supply and exhaust ports, especially at high flow rates.

The spool valve also includes a central bore that extends between the first and second valve portions and which is in fluid communication with the armature chamber. Accordingly, supply fluid can enter through the spool sleeve free end and flow into the armature chamber to maintain the armature at a pressure of the supply fluid.

A spring is positioned within the spool sleeve central bore between the first valve portion and the spool sleeve second end portion. The spring is configured to urge the spool valve towards the armature so as to maintain constant contact between the first valve portion and the armature second end. As a result, the spool valve follows the movement of the armature as a slave. The armature second end and spool valve second valve portion are configured to swivel to reduce valve hysteresis.

An adjustment screw is provided within the pole piece for adjusting axial movement of the spool valve within the spool sleeve central bore relative to flow of electrical current within the coiled conductive wire. The adjusting screw adjusts the position of the armature within the armature chamber, which thereby adjusts the position of the spool valve coupled to the armature.

The present invention is advantageous because the configuration of the spool valve and the physical coupling of the spool valve and armature facilitates reducing valve hysteresis. Furthermore, control valves incorporating a spool valve configuration according to the present invention can achieve linear flow forces, even at high flow rates. Solenoid-actuated control valves according to the present invention can move or "stroke" 4 millimeters (mm) at flow rates up to and exceeding 15 GPM. Heretofore it has been somewhat difficult to control flow rates of this magnitude because of the non-linear flow forces imparted on valve components at these high flow rates. Furthermore, it has been difficult to control flow rates up to and exceeding 15 GPM via conventional solenoid actuated valves because of physical size limitations placed on these valves by internal combustion engines.

Metering at the supply port, in accordance with the present invention is particularly advantageous because fluid flow forces remain linear, thus providing very stable performance of the solenoid valve.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Hydraulic System

Figure 1:
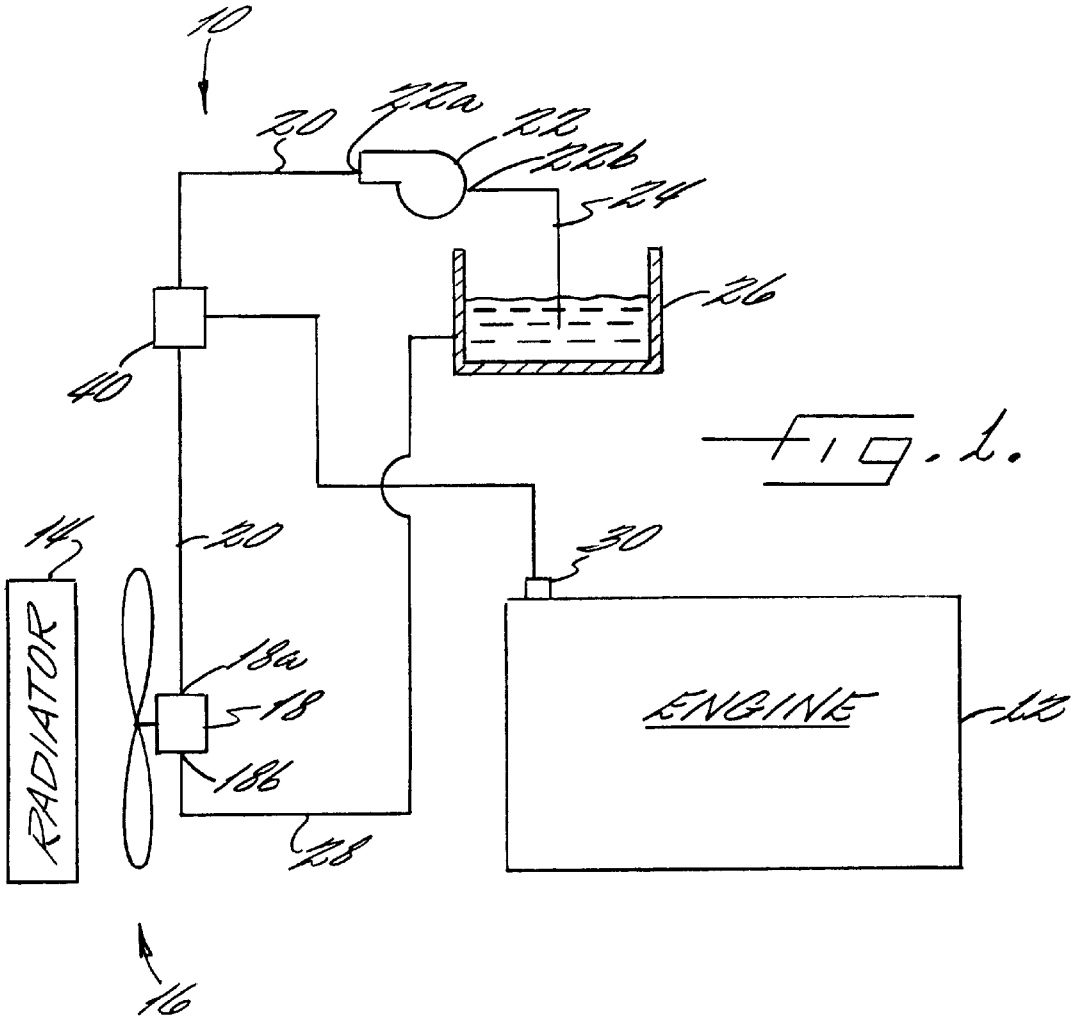
FIG. 1 schematically illustrates a system for controlling the rotational speed of a hydraulically driven engine cooling fan in which a hydraulic solenoid valve according to the present invention may be utilized.

Referring now to FIG. 1, an exemplary system 10 in which a solenoid-actuated control valve according to the present invention may be utilized is schematically illustrated. The reference numeral 12 denotes an internal combustion engine, typically fitted to an automotive vehicle, which is equipped with a radiator 14. A cooling fan 16 is provided for pulling a stream of air across the coils of the radiator 14, to remove heat from engine coolant flowing therethrough, as is understood by those skilled in this art. The cooling fan 16 is rotationally driven by a hydraulic motor 18. Hydraulic motors are well known in this art and need not be described herein.

The intake port 18*a* of the hydraulic motor 18 is connected to the output port 22*a* of a hydraulic fluid pump 22 by a hydraulic conduit 20. The intake port 22*b* of the hydraulic fluid pump 22 is connected to a fluid reservoir 26 by the hydraulic conduit 24 and receives a supply of hydraulic fluid therefrom. An exemplary fluid reservoir may be the power steering fluid reservoir of a vehicle. An outlet port 18*b* of the hydraulic motor 18 is connected by another hydraulic conduit 28 to the fluid reservoir 26 which returns spent hydraulic fluid to the fluid reservoir 26.

The hydraulic conduit 20 incorporates a solenoid-actuated control valve (solenoid valve) 40, as illustrated, for controlling fluid flow to the hydraulic motor 18. The solenoid within the solenoid valve 40 is actuated in response to electrical signals generated by an engine coolant temperature sensor 30 that outputs an electrical signal indicative of the temperature of the coolant of the internal combustion engine 12. An electrical signal indicating an increase in engine coolant temperature preferably causes the solenoid valve to increase fluid flow to the hydraulic motor 18. Conversely, an electrical signal indicating a decrease in engine coolant temperature preferably causes the solenoid valve to decrease fluid flow to the hydraulic motor 18.

Solenoid Valve

Figures 2, 3:
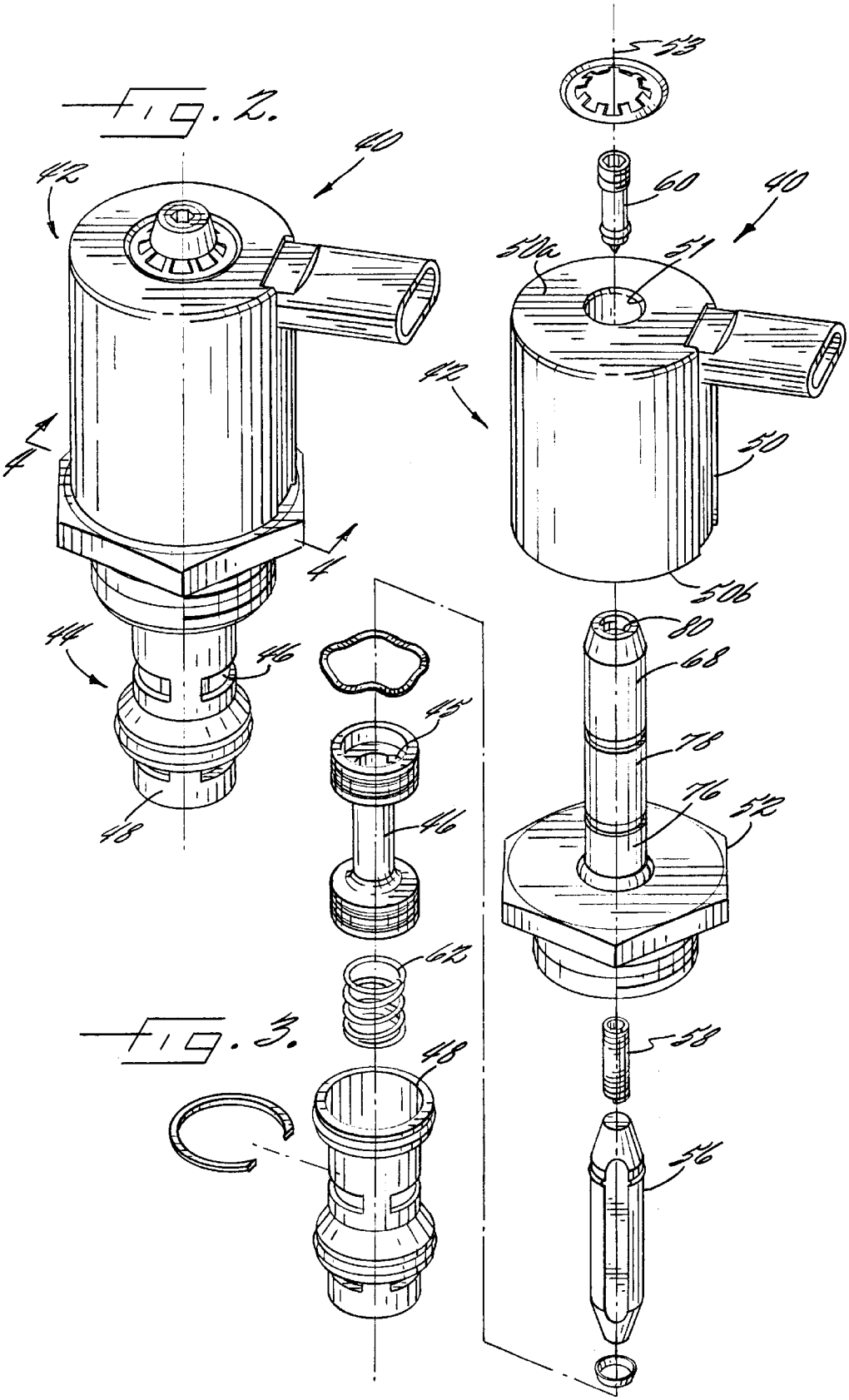
FIG. 2 is a perspective view of a solenoid-actuated control valve according to an embodiment of the present invention.
FIG. 3 is an exploded perspective view of the solenoid-actuated control valve of FIG. 2.

Referring now to FIG. 2, a perspective view of a solenoid valve 40, according to an embodiment of the present invention, is illustrated. The solenoid valve 40 includes a magnet portion 42 and a hydraulic portion 44. The function of the magnet portion 42 is to generate a magnetic field which operates an armature 56 (FIG. 3) therewithin. The armature 56 is mechanically coupled with a spool valve 46 that is slidably secured within a spool sleeve 48 and that is configured to control the flow of hydraulic fluid therethrough.

Referring now to FIG. 3, an exploded perspective view of the solenoid valve of FIG. 2 is illustrated. The magnet portion 42 includes an annular flux housing 50 having opposite first and second end portions 50*a*, 50*b* and an axial bore 51 extending between the first and second end portions 50*a*, 50*b*. The axial bore 51 defines an axial direction indicated by reference number 53. As will be described below with respect to FIG. 4, the annular flux housing 50 is configured to enclose an insulating bobbin disposed therewithin and having conductive wire wrapped therearound for generating a magnetic field. A threaded hex washer 52 is configured to be secured to the annular flux housing second end portion 50*b*, as illustrated.

A flux return tube 76, isolation tube 78 and pole piece 68 are secured together within the annular flux housing axial bore 51 to form a chamber 80 within which the armature 56 can slidably move along the axial direction 53. The flux return tube 76 is secured to the threaded hex washer 52 as illustrated. A magnetic armature 56 and spring 58 are slidably secured within the armature chamber 80. An adjusting screw 60 is threadingly secured within an end of the pole piece 68.

Still referring to FIG. 3, a spool valve 46 is slidably secured within a spool sleeve 48. As will be described in detail with respect to FIG. 4, a spring 62 is configured to bias the spool valve 46 towards the armature 56, so that the spool valve 46 is mechanically coupled with the armature 56 and moves with the armature 56 as a slave.

Figure 4:
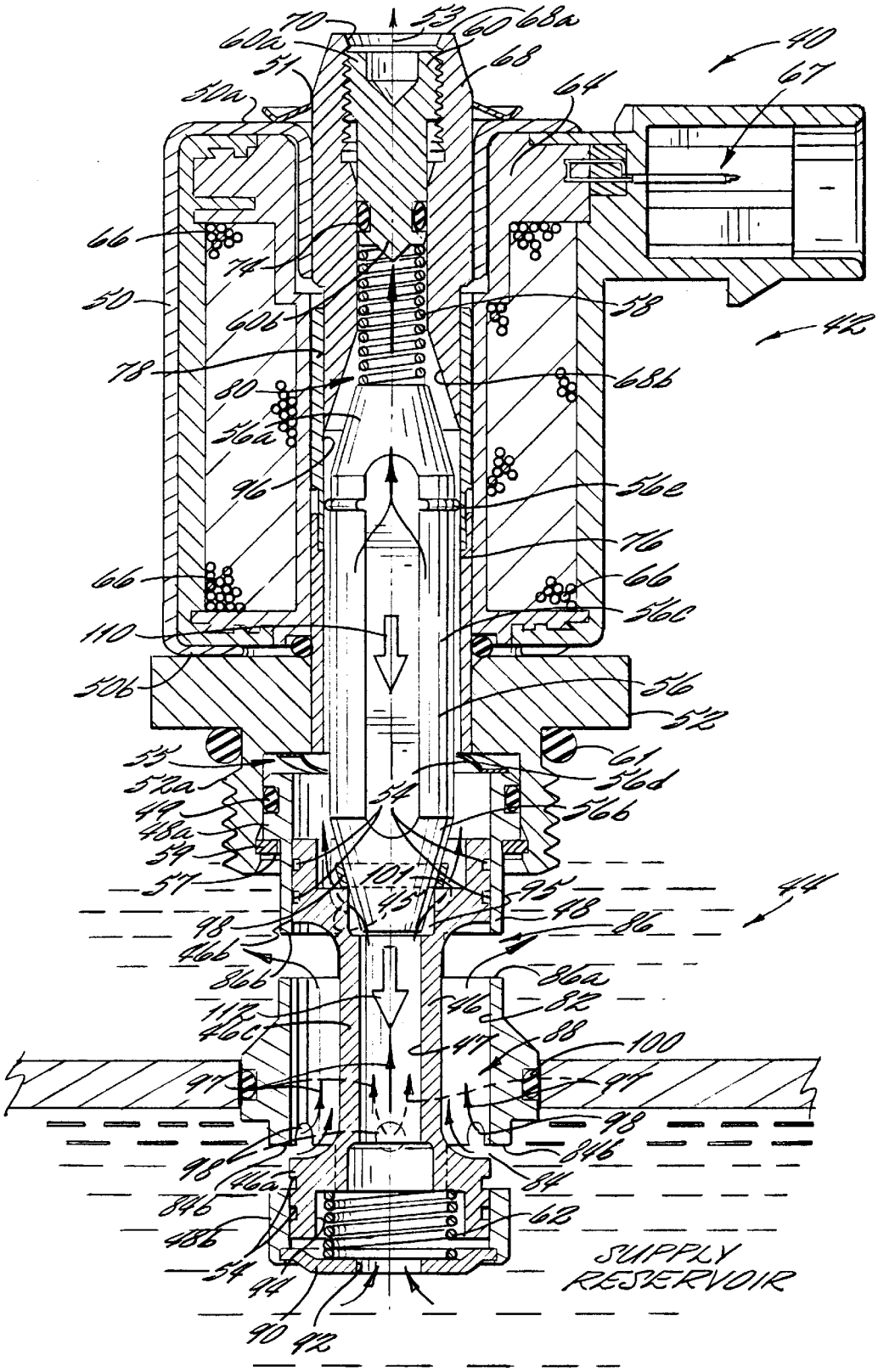
FIG. 4 is a cross-sectional view of the solenoid-actuated control valve of FIG. 2 taken along lines 4—4.

Referring now to FIG. 4, the magnet portion 42 and hydraulic portion 44 of the solenoid valve 40 of FIG. 4 will now be described in greater detail. Disposed within the annular flux housing 50 is a bobbin 64 having conductive wire 66 coiled therearound for generating a magnetic field when electrical current flow is induced therein via electrical terminals 67. Magnetic coils for operating solenoids are well understood by those skilled in this art and need not be described further herein.

A magnetic pole piece 68 is disposed within the annular flux housing axial bore 51 adjacent the annular flux housing first end portion 50*a*, as illustrated. The pole piece 68 includes an axial bore 70 extending along the axial direction 53 between opposite first and second ends 68*a*, 68*b*, as illustrated. A portion of the pole piece axial bore 70 adjacent the pole piece first end 68*a* is threaded and configured to receive a correspondingly-threaded adjusting screw 60 therein. As will be described in detail below, the adjusting screw 60 is configured to adjust or calibrate the position of the armature 56.

In the illustrated embodiment, the adjusting screw 60 has opposite first and second ends 60*a*, 60*b*. A seal 74, such as an O-ring, extends around the circumference of the adjusting screw 60 adjacent the adjusting screw second end 60*b* and is configured to prevent hydraulic fluid from escaping from the armature chamber 80 through the pole piece axial bore 70. A spring 58 is positioned between the adjusting screw second end 60*b* and the armature 56 and is configured to bias the armature 56 along the axial direction 53 away from the pole piece second end 68*b*. The adjusting screw 60 serves as means for adjusting (i.e., calibrating) the axial positions of both the armature 56 within the armature chamber 80 and the spool valve 46 within the spool sleeve central bore 82 relative to flow of electrical current within the coiled conductive wire 66 producing a magnetic field.

In the illustrated embodiment, the pole piece first end 68*a* extends outwardly along the axial direction 53 from the annular flux housing 50. A retaining ring 72 is configured to maintain the pole piece 68 securely within the annular flux housing axial bore 51. In the illustrated embodiment, the pole piece second end 68*b* has an inverted conical shape configured to receive a conical-shaped end of the armature 56.

Still referring to FIG. 4, the armature 56 is slidably secured within the armature chamber 80 as illustrated. The armature 56 includes a body portion 56*c* terminating at opposite first and second ends 56*a*, 56*b*. The annular flux housing 50, armature 56, flux return tube 76, hex washer 52 and pole piece 68 form a magnetic flux circuit such that flow of electrical current within the coils of conductive wire 66 produces a magnetic field that causes the armature first end 56*a* to move in the axial direction 53 along the armature chamber 80 towards the pole piece second end 68*b*. The spring 58 biases against the armature first end 56*a* to counter the magnetic force attracting the armature 56 towards the pole piece 68.

Still referring to FIG. 4, the flux return tube 76 extends through the threaded hex washer 52 and terminates at a central bore 55 in the threaded end 52*a* of the threaded hex washer 52, as illustrated. The central bore 55 in the threaded end 52*a* of the threaded hex washer 52 is configured to receive the first end 48*a* of the spool sleeve 48, as illustrated. A circumferential seal 49, such as an O-ring, extends around the first end 48*a* of the spool sleeve 48 as illustrated for preventing hydraulic fluid from leaking between the spool sleeve 48 and the inner surface 57 of the central bore 55. A valve sleeve retaining ring 59 also extends around the first end 48*a* of the spool sleeve 48, as illustrated, for maintaining the spool sleeve first end 48*a* securely within the central bore 55, as illustrated.

The spool sleeve 48 has a central bore 82 extending therethrough between opposite first and second end portions 48*a*, 48*b*, as illustrated. The spool sleeve first end portion 48*a* is secured within the central bore 55 of the threaded hex washer threaded end 52*a* as described above. Effectively, the spool sleeve first end portion 48*a* is secured to the flux housing second end portion 50*b* such that the spool sleeve central bore 82 and the armature chamber 80 within the flux housing axial bore 51 are in fluid communication with each other.

A supply port 84 is formed within the spool sleeve second end 48*b*, as illustrated. An exhaust port 86 is formed within the spool sleeve first end 48*a*, as illustrated. Both the supply port 84 and exhaust port 86 are in respective fluid communication with the spool sleeve central bore 82. In the illustrated embodiment, the supply port 84 includes two opposing slots 84*a*, 84*b* formed in the spool sleeve 48. Similarly, the exhaust port includes two opposing slots 86*a*, 86*b* formed in the spool sleeve 48. It is to be understood that the supply and exhaust ports 84, 86 may have various configurations, and are not limited to the illustrated embodiment. For example, a plurality of apertures may be utilized in lieu of slots for either or both of the supply and exhaust ports 84, 86.

In the illustrated embodiment, the spool valve 46 has a general hour-glass shape and is slidably secured within the spool sleeve central bore 82. The hour-glass shape of the spool valve 46 helps produce linear flow forces resulting from hydraulic fluid entering the supply port 84 and exiting through the exhaust port 86 at high flow rates. The spool valve 46 has spaced-apart first and second valve portions 46*a*, 46*b* joined together by an intermediate body portion 46*c*. A central bore 47 extends through the spool valve 46 between the first and second valve portions 46*a*, 46*b* along the axial direction 53.

The spool valve second valve portion 46*b* includes a recessed portion 95 configured to receive the armature second end 56*b* and to allow the armature 56 and spool valve 46 to swivel with respect to each other. One or more notches 45 are preferably provided at the second valve portion 46*b* adjacent the central bore 47, as illustrated, to facilitate the flow of fluid around the armature second end 56*b* and upwardly into the spool valve armature chamber 80. The first and second spool valve portions 46*a*, 46*b* each include a plurality of pressure equalization grooves 54, as illustrated. Spool valve pressure equalization grooves are well known in this art and need not be described further herein.

The intermediate body portion 46*c* has a smaller diameter than the first and second valve portions 46*a*, 46*b* and forms, in combination with the spool sleeve central bore 82, an annular chamber 88 in fluid communication with the supply and exhaust ports 84, 86. The first valve portion 46*a* is configured to control fluid flow through the supply port 84 and the second valve portion 46*b* is configured to control fluid flow through the exhaust port 86. The spool sleeve 48 further comprises a plurality of metering apertures 98, as illustrated, which serve as means for metering supply fluid at the supply port 84.

The spool sleeve second end 48*b* includes an end cap 90 having an aperture 92 formed through a central portion thereof, as illustrated in FIG. 4. A spring 62 is positioned within the spool sleeve central bore 82 between the second valve portion 46*b* and the spool sleeve second end portion 48*b*. The spool valve first end portion 46*a* includes a cavity 94 along the axial direction thereof that is configured to receive an end of the spring 62, as illustrated. The spring 62 is configured to bias the spool valve 46 towards the armature 56 so as to maintain constant mechanical coupling between the first valve portion 46*a* and the armature second end 56*b*. Accordingly, the spool valve 46 can follow the movement of the armature 56 as a slave.

Fluid from a supply reservoir enters the supply port 84, flows through the annular chamber 88 and exits via the exhaust port 86, as indicated by the arrows 97 in FIG. 4. Preferably, when the solenoid valve 40 is in an installed configuration, the supply port 84 is isolated from the exhaust port 86 via a seal 100, such as an O-ring, extending circumferentially around an intermediate portion 48*c* of the spool sleeve, as illustrated. The threaded hex washer 52 is configured to be threadingly engaged within a correspondingly threaded bore. A seal 61, such as an O-ring, circumferentially extends around the threaded end 52*a* to provide a seal against exhaust pressure.

In the illustrated embodiment, the armature first and second end portions 56*a*, 56*b* each have a generally conical configuration, wherein the outside diameter of each respective first and second end portion 56*a*, 56*b* decreases along the axial direction 53 away from the armature body portion 56*c*. The armature body portion 56*c* also includes a substantially flat, axially extending portion 56*d*. The armature body portion 56*c* also includes an outwardly extending circumferential bearing 56*e* that is configured to reduce contact between the armature body portion 56*c* and the inner surface 96 of the armature chamber 80. The circumferential bearing 56*e* allows the armature 56 to compensate for misalignment between the pole piece 68 and the spool sleeve 48 thereby reducing valve hysteresis.

In the illustrated embodiment, the spool valve second end portion 46*b* includes a cavity 95 along the axial direction thereof that is configured to receive the armature second end 56*b*. The cavity 95 includes a step or ledge 97, as illustrated. A stop 98 extending around a portion of the armature second end 56*b* is configured to prevent the armature second end 56*b* from extending into the spool valve cavity 95 beyond a predetermined amount. The conical configuration of the armature second end 56*b* within the cavity 95 of the spool valve second end 46*b* provides a pivotable joint that helps reduce valve hysteresis.

The armature 56 is pressure balanced because supply fluid is allowed to enter through the end cap aperture 92, flow upwardly through the spool valve central bore 47 and into the armature chamber 80. The flat portion 56*d* of the armature body portion 56*c* facilitates the flow of supply fluid into the armature chamber 80. Accordingly, the armature 56 is maintained at the same pressure as the supply fluid.

Solenoid Valve Operation

Figure 5:
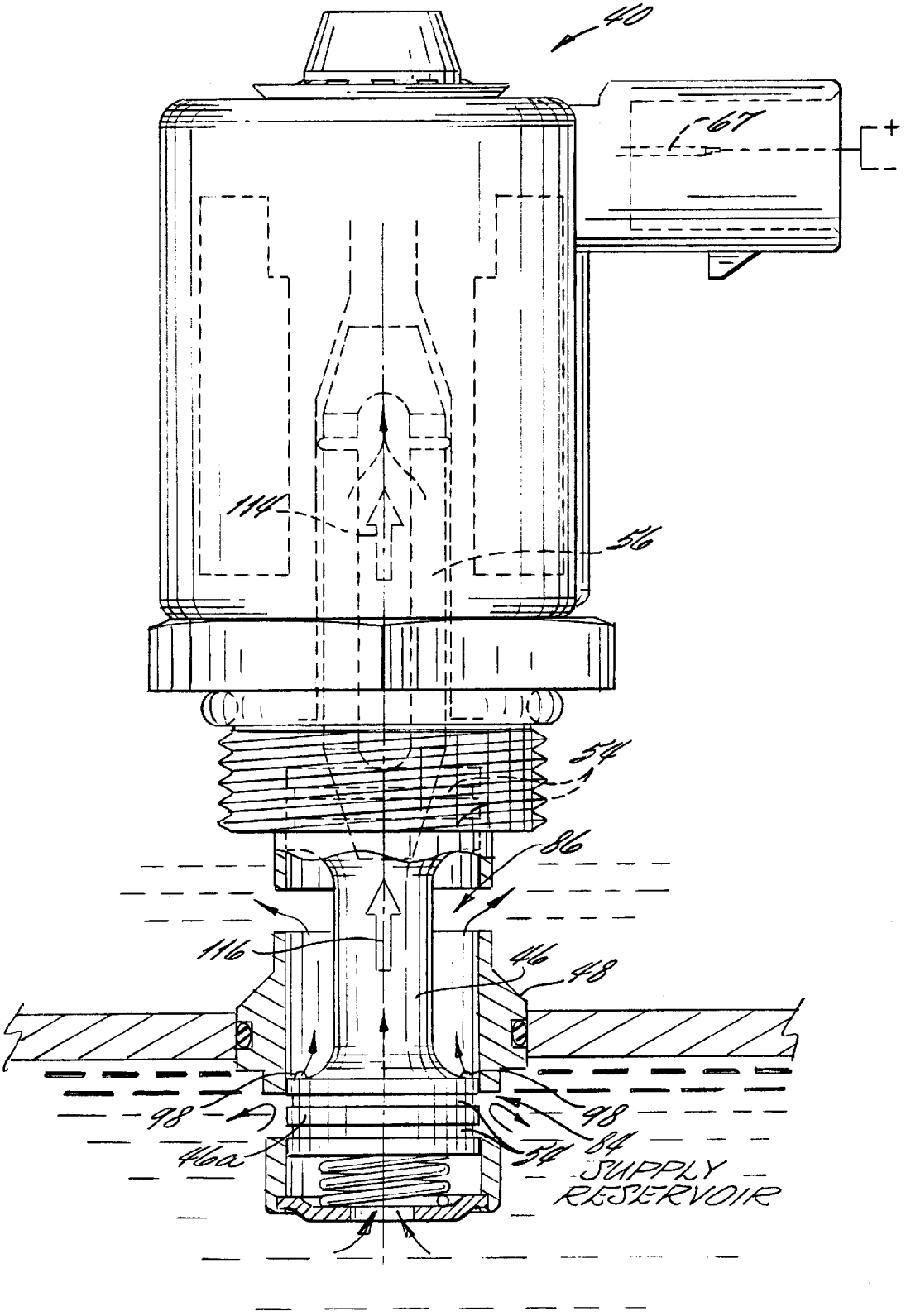
FIG. 5 is a partially-fragmented side view of the solenoid-actuated control valve of FIG. 2 illustrating actuation of the armature to thereby meter flow at the supply port.
Figure 6:
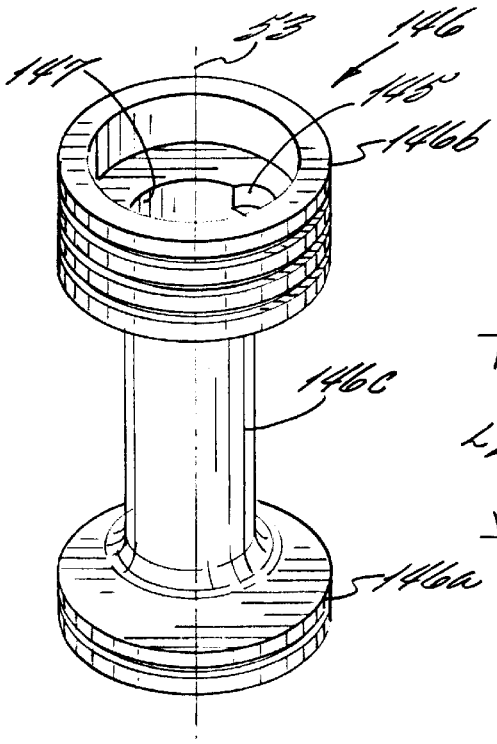
FIGS. 6 and 7 illustrate a spool valve for a solenoid-actuated control valve, according to another embodiment of the present invention.
Figure 7:
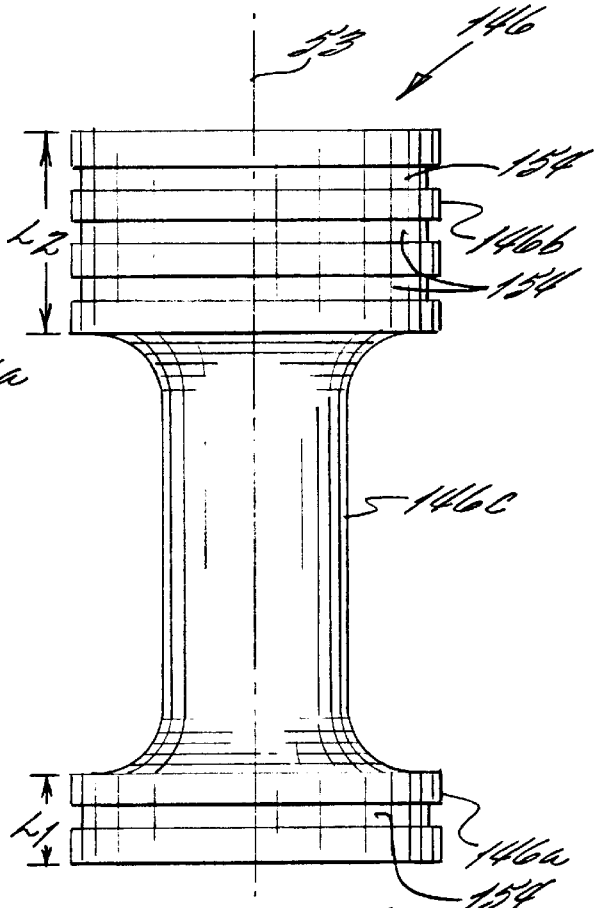

Referring to FIGS. 4 and 5, operation of the illustrated solenoid valve 40 will now be described. In the absence of a magnetic field, the armature 56 is biased axially downward away from the pole piece 68, via spring 58, as indicated by arrow 110. As a result, the armature second end 56*b* pushes the spool valve second end 46*b* axially downward as indicated by arrow 112, thereby causing the spool valve first end 46*a* to move downwardly against the spring 62 to open the supply port 84.

When electrical current is applied to the coiled conductive wire 66, via terminals 67, a magnetic field is generated such that the pole piece 68 magnetically attracts the armature first end 56*a*, causing the armature 56 to move axially upwards towards the pole piece 68. Because the spring 62 causes the spool valve 46 to follow the armature as a slave, the spool valve 46 moves axially upwards, thereby causing the spool valve first end 46*a* to move upwardly to close the supply port 84. According to an embodiment of the present invention, when electrical current is applied to the coiled conductive wires 66, the armature 56 and spool valve 46 move to a position where the sum of the fluid flow forces on them equals zero.

As would be understood by those skilled in the art of solenoid valves, upward movement of the armature 56 may be controlled by controlling the amount of electrical current applied to the coiled conductive wire via the terminals 67. Accordingly, in the illustrated embodiment of FIGS. 4 and 5, the spool valve 46 meters fluid flow at the supply port 84. Metering at the supply port 84, in accordance with the present invention is particularly advantageous because fluid flow forces remain linear, thus providing very stable performance of the solenoid valve 40.

As illustrated in FIG. 5, electrical current has been applied to the terminals 67, thereby causing a magnetic field to be generated which causes the armature 56 to move axially upwards as indicated by arrow 114. As a result, the spool valve 46 follows the armature 56 axially upwards as indicated by arrow 116. The spool valve first end 46*a* has moved axially upwards so as to close the supply port 84, as illustrated. However, in the illustrated embodiment, the metering apertures 98 remain partially open, thereby permitting hydraulic fluid to flow from the supply reservoir through the spool sleeve central bore 82 and out the exhaust port 86. The illustrated spool sleeve 48 and spool valve 46 are configured to provide hydraulic fluid flow of between about 0.01 GPM and about 25 GPM with a pressure drop across the spool sleeve 48 of between 0 and about 100 pounds per square inch (psi), depending on the flow rate.

Alternative Spool Valve and Spool Sleeve Embodiment

Referring now to FIGS. 6–9, a spool valve 146 and spool sleeve 148, according to another embodiment of the present invention, are illustrated. The illustrated spool valve 146 has a generally hour-glass shape and is configured to be slidably secured within the central bore 182 of spool sleeve 148. The spool valve 146 has spaced apart first and second valve portions 146*a*, 146*b* joined together by an intermediate body portion 146*c*, and a central bore 147 extending therethrough along the axial direction 153. The axial length $L_1$ of the first valve portion 146*a* is less than the axial length $L_2$ of the second valve portion 146*b*, as illustrated. One or more notches 145 are preferably provided at the second valve portion 146*b* adjacent the central bore 147, as illustrated, to facilitate the flow of fluid around an armature and upwardly into the spool valve armature chamber, as described above. In addition, both the first and second valve portions 146*a*, 146*b* have respective pressure equalization grooves 154.

Figure 8:
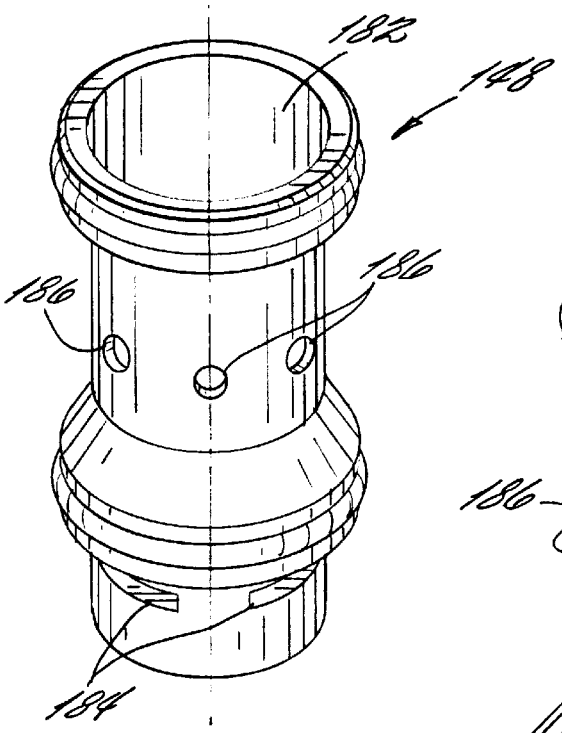
FIGS. 8 and 9 illustrate a spool sleeve for a solenoid-actuated control valve, according to another embodiment of the present invention.
Figure 9:
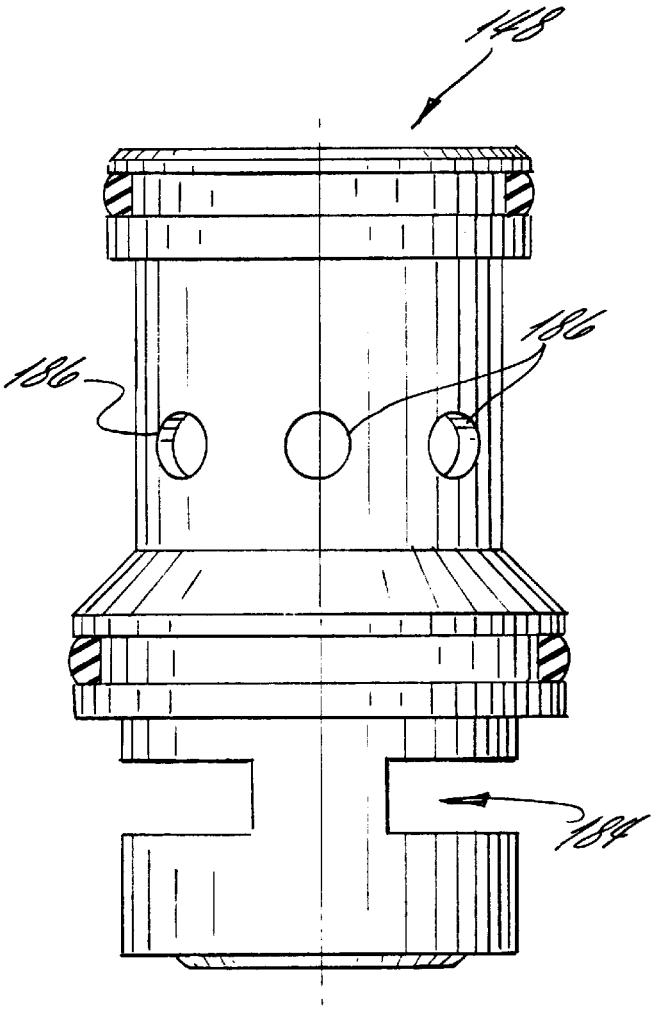

The spool sleeve 148, illustrated in FIGS. 8 and 9 is similar to the spool sleeve 48 described above and illustrated in FIGS. 3 and 4 with the exception that the exhaust port 184 includes a plurality of apertures 186 instead of slots. Used within the spool sleeve 148 of FIGS. 8 and 9, the spool valve 146 is configured to meter hydraulic fluid flow at the exhaust apertures 186, instead of at the supply port 184.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A flow control apparatus, comprising:

an annular flux housing having an axial bore extending therethrough;

a coil configured to generate a magnetic field disposed within said flux housing;

a magnetic pole piece disposed within said flux housing axial bore;

a magnetic armature slidably secured within said flux housing axial bore;

biasing means positioned between said pole piece and said armature, said biasing means configured to bias said armature away from said pole piece;

a spool sleeve secured to said flux housing, said spool sleeve having a supply port and an exhaust port; and a spool valve slidably secured within said spool sleeve, said spool valve mechanically coupled with said armature such that said spool valve follows movement of said armature as a slave while remaining in contact with said armature in all positions thereof, said spool valve configured to control fluid entering said supply port and exiting said exhaust port.

2. A flow control apparatus according to claim 1 wherein said spool valve and said armature are mechanically coupled via a spring that urges said spool valve into contact with said armature.

3. A flow control apparatus according to claim 1 wherein said spool valve comprises spaced-apart first and second valve portions on respective ends of an intermediate body portion, said first valve portion configured to meter fluid flowing into said supply port.

4. A flow control apparatus according to claim 3 wherein said intermediate body portion has a smaller diameter than said first and second valve portions and wherein said intermediate body portion forms an annular chamber within said spool sleeve in communication with said supply and exhaust ports.

5. A flow control apparatus according to claim 1 further comprising means for maintaining said armature at a pressure of fluid entering said supply port.

6. A flow control apparatus according to claim 1 further comprising means for adjusting axial movement of said spool valve within said spool sleeve relative to a flow of electrical current within said coil.

7. A flow control apparatus according to claim 6 wherein said adjusting means comprises means for axially adjusting a position of said armature within said flux housing axial bore.

8. A flow control apparatus, comprising:

an annular flux housing having opposite first and second end portions and an axial bore extending between said first and second end portions;

a bobbin disposed within said flux housing, said bobbin having conductive wire coiled therearound for generating a magnetic field;

a magnetic pole piece disposed within said flux housing axial bore adjacent said flux housing first end portion, said pole piece having opposite first and second ends;

an armature chamber disposed within said flux housing axial bore adjacent said flux housing second end portion;

a magnetic armature slidably secured within said armature chamber, said armature including a body portion terminating at opposite first and second ends;

first biasing means positioned within said armature chamber between said pole piece second end and said armature first end, said first biasing means configured to axially bias said armature first end away from said pole piece second end;

wherein said flux housing, armature and pole piece form a magnetic flux circuit such that flow of electrical current within said coiled conductive wire causes said armature first end to move axially within said armature chamber towards said pole piece second end;

a spool sleeve comprising:

opposite first and second end portions;

a central bore terminating at said first and second end portions;

wherein said spool sleeve first end portion is secured to said flux housing second end portion such that said spool sleeve central bore and said armature chamber are in fluid communication; and a supply port adjacent said spool sleeve first end portion and an exhaust port adjacent said spool sleeve second end portion, said supply and exhaust ports in respective communication with said spool sleeve central bore;

a spool valve slidably secured within said spool sleeve central bore and having spaced-apart first and second valve portions on respective ends of an intermediate body portion, said first valve portion configured to control fluid flow through said supply port and said second valve portion configured to control fluid flow through said exhaust port;

wherein said intermediate body portion has a smaller diameter than said first and second valve portions and forms, in combination with said spool sleeve central bore, an annular chamber in communication with said supply and exhaust ports; and second biasing means positioned within said spool sleeve central bore between said first valve portion and said spool sleeve second end portion, said second biasing means configured to bias said spool valve towards said armature so as to maintain contact between said first valve portion and said armature second end such that said spool valve follows movement of said armature as a slave while remaining in contact with said armature in all positions thereof.

9. A flow control apparatus according to claim 8 wherein said spool valve further comprises a central bore extending between said first and second valve portions, wherein said spool valve central bore is in fluid communication with said armature chamber such that supply fluid entering said spool sleeve second end portion can surround said armature in said armature chamber and maintain said armature at a pressure of said supply fluid.

10. A flow control apparatus according to claim 8 wherein said armature body portion comprises a substantially flat, axially extending portion.

11. A flow control apparatus according to claim 8 wherein said armature first and second end portions each have a generally conical configuration wherein an outside diameter of each respective first and second end portion decreases in a direction away from said body portion.

12. A flow control apparatus according to claim 11 wherein said second valve portion comprises a recessed portion configured to receive said conical armature second end portion to allow said armature and spool valve to swivel with respect to each other.

13. A flow control apparatus according to claim 8 wherein said armature body portion comprises an outwardly extending circumferential bearing, and wherein said bearing is configured to reduce contact between said armature body portion and said armature chamber.

14. A flow control apparatus according to claim 8 wherein said spool sleeve further comprises means for metering supply fluid entering said spool valve, said metering means located adjacent said supply port.

15. A flow control apparatus according to claim 14 wherein said metering means comprises at least one aperture formed through said spool sleeve.

16. A flow control apparatus according to claim 8 wherein said supply port comprises at least one slot formed in said spool sleeve.

17. A flow control apparatus according to claim 8 wherein said exhaust port comprises a plurality of circumferentially spaced-apart apertures formed in said spool sleeve.

18. A flow control apparatus according to claim 8 further comprising means for adjusting axial movement of said spool valve within said spool sleeve central bore relative to a flow of electrical current within said coiled conductive wire, said adjusting means located within said pole piece first end.

19. A flow control apparatus according to claim 18 wherein said adjusting means comprises means for axially adjusting a position of said armature within said armature chamber.

20. A flow control apparatus according to claim 8 further comprising means for isolating said supply port from said exhaust port, said isolating means located on said spool sleeve between said supply and exhaust ports.

21. A flow control apparatus, comprising:

an annular flux housing having opposite first and second end portions and an axial bore extending between said first and second end portions;

a bobbin disposed within said flux housing, said bobbin having conductive wire coiled therearound for generating a magnetic field;

a magnetic pole piece disposed within said flux housing axial bore adjacent said flux housing first end portion, said pole piece having opposite first and second ends;

an armature chamber disposed within said flux housing axial bore adjacent said flux housing second end portion;

a magnetic armature slidably secured within said armature chamber, said armature including a body portion terminating at opposite first and second ends, said armature first and second end portions each having a generally conical configuration wherein an outside diameter of each respective first and second end portion decreases in a direction away from said body portion;

first biasing means positioned within said armature chamber between said pole piece second end and said armature first end, said first biasing means configured to axially bias said armature first end away from said pole piece second end;

wherein said flux housing, armature and pole piece form a magnetic flux circuit such that flow of electrical current within said coiled conductive wire causes said armature first end to move axially within said armature chamber towards said pole piece second end;

a spool sleeve comprising:

opposite first and second end portions;

a central bore terminating at said first and second end portions;

wherein said spool sleeve first end portion is secured to said flux housing second end portion such that said spool sleeve central bore and said armature chamber are in fluid communication; and a supply port adjacent said spool sleeve first end portion and an exhaust port adjacent said spool sleeve second end portion, said supply and exhaust ports in respective communication with said spool sleeve central bore;

a spool valve slidably secured within said spool sleeve central bore and having spaced-apart first and second valve portions on respective ends of an intermediate body portion, said first valve portion configured to control fluid flow through said supply port and said second valve portion configured to control fluid flow through said exhaust port;

wherein said intermediate body portion has a smaller diameter than said first and second valve portions and forms, in combination with said spool sleeve central bore, an annular chamber in communication with said supply and exhaust ports;

second biasing means positioned within said spool sleeve central bore between said first valve portion and said spool sleeve second end portion, said second biasing means configured to bias said spool valve towards said armature so as to maintain contact between said first valve portion and said armature second end such that said spool valve follows movement of said armature as a slave while remaining in contact with said armature in all positions thereof; and means for adjusting axial Movement of said spool valve within said spool sleeve central bore relative to a flow of electrical current within said coiled conductive wire, said adjusting means located within said pole piece first end.

22. A flow control apparatus according to claim 21 wherein said spool valve further comprises a central bore extending between said first and second valve portions, wherein said spool valve central bore is in fluid communication with said armature chamber such that supply fluid entering said spool sleeve second end portion can surround said armature in said armature chamber and maintain said armature at a pressure of said supply fluid.

23. A flow control apparatus according to claim 21 wherein said armature body portion comprises a substantially flat, axially extending portion.

24. A flow control apparatus according to claim 21 wherein said armature body portion comprises an outwardly extending circumferential bearing, and wherein said bearing is configured to reduce contact between said armature body portion and said armature chamber.

25. A flow control apparatus according to claim 21 wherein said spool sleeve further comprises means for metering supply fluid entering said spool valve, said metering means located adjacent said supply port.

26. A flow control apparatus according to claim 25 wherein said metering means comprises at least one aperture formed through said spool sleeve.

27. A flow control apparatus according to claim 21 wherein said supply port comprises at least one slot formed in said spool sleeve.

28. A flow control apparatus according to claim 21 wherein said exhaust port comprises a plurality of circumferentially spaced-apart apertures formed in said spool sleeve.

29. A flow control apparatus according to claim 21 wherein said adjusting means comprises means for axially adjusting a position of said armature within said armature chamber.

30. A flow control apparatus according to claim 21 wherein said second valve portion comprises a recessed portion configured to receive said conical armature second end portion to allow said armature and spool valve to swivel with respect to each other.

31. A hydraulic system, comprising:

a reservoir of fluid;

a hydraulic motor having an inlet port; menas for supplying fluid from said reservoir to said hydraulic motor inlet port; and a flow control apparatus that controls flow of said fluid from said fluid supplying means to said hydraulic motor inlet port, said flow control apparatus comprising:

an annular flux housing having an axial bore extending therethrough;

a coil configured to generate a magnetic field disposed within said flux housing;

a magnetic pole piece disposed within said flux housing axial bore;

biasing means positioned between said pole piece and said armature, said biasing means configured to bias said armature away from said pole piece;

a spool sleeve secured to said flux housing, said spool sleeve having a supply port and an exhaust port; and a spool valve slidably secured within said spool sleeve, said spool valve mechanically coupled with said armature such that said spool valve follows movement of said armature as a slave while remaining in contact with said armature in all positions thereof, said spool valve configured to control fluid entering said supply port and exiting from said exhaust port.

32. A flow control apparatus according to claim 31 wherein said spool valve and said armature are mechanically coupled via a spring that urges said spool valve into contact with said armature.

33. A flow control apparatus according to claim 31 wherein said spool valve comprises spaced-apart first and second valve portions on respective ends of an intermediate body portion, said first valve portion configured to meter fluid flowing into said supply port.

34. A flow control apparatus according to claim 33 wherein said intermediate body portion has a smaller diameter than said first and second valve portions and wherein said intermediate body portion forms an annular chamber within said spool sleeve in communication with said supply and exhaust ports.

35. A flow control apparatus according to claim 31 further comprising means for maintaining said armature at a pressure of fluid entering said supply port.

36. A flow control apparatus according to claim 31 further comprising means for adjusting axial movement of said spool valve within said spool sleeve relative to a flow of electrical current within said coil.

37. A flow control apparatus according to claim 36 wherein said adjusting means comprises means for axially adjusting a position of said armature within said flux housing axial bore.

* * * * *